US011840812B1

(12) United States Patent
Wu et al.

(10) Patent No.: US 11,840,812 B1
(45) Date of Patent: Dec. 12, 2023

(54) STEEL-CONCRETE COMPOSITE BRIDGE DECK SLAB WITH STEEL TUBE-PREFOBOND RIB SHEAR CONNECTORS AND METHOD FOR CONSTRUCTING SAME

(71) Applicants: Fuzhou University, Fuzhou (CN); Huadong Engineering Corporation Limited, Hangzhou Province (CN)

(72) Inventors: Qingxiong Wu, Fuzhou (CN); Qu Wang, Fuzhou (CN); Xiaogang Li, Fuzhou (CN); Yuanhui Zhan, Fuzhou (CN); Kangming Chen, Fuzhou (CN); Yilun Yang, Fuzhou (CN)

(73) Assignees: Fuzhou University, Fuzhou (CN); Huadong Engineering Corporation Limited, Hangzhou Province (CN)

( * ) Notice: Subject to any disclaimer, the term of this patent is extended or adjusted under 35 U.S.C. 154(b) by 0 days.

(21) Appl. No.: 18/327,083

(22) Filed: Jun. 1, 2023

(30) Foreign Application Priority Data

Sep. 29, 2022 (CN) ..... 202211197228.5

(51) Int. Cl.
*E01D 19/12* (2006.01)
*E01D 101/26* (2006.01)

(52) U.S. Cl.
CPC ..... *E01D 19/125* (2013.01); *E01D 2101/268* (2013.01)

(58) Field of Classification Search
CPC ..... E01D 19/125; E01D 2101/268
See application file for complete search history.

(56) References Cited

U.S. PATENT DOCUMENTS 5,509,243 A * 4/1996 Bettigole ..... E04B 5/36 52/414
5,664,378 A * 9/1997 Bettigole ..... E01D 19/125 404/70
6,112,629 A * 9/2000 Mangone ..... E04C 2/425 83/13
6,871,462 B2 * 3/2005 Azizinamini ..... E04B 5/29 52/432
7,197,854 B2 * 4/2007 Bettigole ..... E01D 19/125 52/414
10,513,858 B2 * 12/2019 Do Carmo Pacheco . E04B 1/22
2003/0115815 A1 * 6/2003 Azizinamini ..... E01D 19/125 404/71
2005/0115195 A1 * 6/2005 Bettigole ..... E01D 19/125 52/782.1

(Continued)

FOREIGN PATENT DOCUMENTS

CN 207331459 U 5/2018
CN 111879581 A 11/2020

(Continued)

*Primary Examiner* — Abigail A Risic

(57) ABSTRACT

A steel-concrete composite bridge deck slab with steel tube-perfobond rib shear connectors and a method for constructing the same. The steel-concrete composite bridge deck slab structurally includes a steel bottom plate, a concrete layer, transverse perforated steel plate units provided on the steel bottom plate, steel grids arranged on upper surfaces of the transverse perforated steel plate units and longitudinal steel tubes arranged in an inserted manner on the transverse perforated steel plate units.

9 Claims, 3 Drawing Sheets

(56) References Cited

U.S. PATENT DOCUMENTS

| | | | | |
|---|---|---|---|---|
| 2005/0183357 | A1* | 8/2005 | Heuvel | E01D 2/02 52/258 |
| 2006/0272111 | A1* | 12/2006 | Kim | E01D 19/125 14/73 |
| 2007/0000077 | A1* | 1/2007 | Wilson | E01D 19/125 14/73 |
| 2014/0109325 | A1* | 4/2014 | Han | E04B 5/10 14/73 |

FOREIGN PATENT DOCUMENTS

| | | | |
|---|---|---|---|
| CN | 214328517 | U | 10/2021 |
| CN | 217896219 | U | 11/2022 |
| CN | 218643190 | U | 3/2023 |

* cited by examiner

STEEL-CONCRETE COMPOSITE BRIDGE DECK SLAB WITH STEEL TUBE-PREFOBOND RIB SHEAR CONNECTORS AND METHOD FOR CONSTRUCTING SAME

FIELD OF TECHNOLOGY

The present disclosure belongs to the technical field of bridge engineering, and particularly relates to a steel-concrete composite bridge deck slab with steel tube-perfobond rib shear connectors and a construction method therefor.

BACKGROUND

The main body structure of a steel-concrete composite bridge deck slab includes a steel plate below and a concrete layer above. Further, shear keys is intended to be arranged on the steel plate below, and steel grids is intended t be arranged in the concrete layer above, so as to achieve relatively high structural strength of the bridge deck slab.

On the other hand, the above common shear keys for the bridge deck slab, i.e., the PBL shear keys, are also known as perforated steel plate shear keys. Concrete bolts are formed on the concrete at openings of the steel plate to guarantee the basic shear effect.

A Chinese utility model with publication number CN207331459U and publication date: May 8, 2018 discloses an orthotropic steel plate-concrete composite bridge deck slab, including an orthotropic steel plate, bar-mat reinforcements and a concrete structural layer, wherein the orthotropic steel plate includes a bottom plate and several T-shaped steel; the several T-shaped steel is arranged at an interval in a longitudinal bridge direction on the upper surface of the steel bottom plate, the bar-mat reinforcements are paved on the flanges of the T-shaped steel, and several flange baffle plates are further welded to the upper surface of the steel bottom plate.

According to the steel plate-concrete composite bridge deck slab in the utility model, the way of further improving the structural strength of the bridge deck slab mainly includes: 1), a common steel plate is upgraded to the T-shaped steel; and 2), the baffle plates on both sides are additionally arranged. Finally, the composite bridge deck slab can exactly improve the bending strength in the transverse bridge direction to a certain extent.

However, the composite bridge deck slab at least has the following shortcomings in a long-term actual using process, which is the technical problem to be solved by the present disclosure:

it is relatively insufficient in bending strength in the longitudinal bridge direction and lacks an upward continuous reinforcement structure in the longitudinal bridge direction. In other words, the baffle plates on both sides cannot significantly improve the overall upward reinforcing effect in the longitudinal bridge direction.

Therefore, in conclusion, it is an urgent need of a novel steel-concrete composite bridge deck slab with higher bending strength and shear capacity in the transverse bridge direction and the longitudinal bridge direction at present.

SUMMARY

The present disclosure provides the steel-concrete composite bridge deck slab with steel tube-perfobond rib shear connectors, which can guarantee that the steel-concrete composite bridge deck slab has high bending strength and shear capacity in a transverse bridge direction and a longitudinal bridge direction by arranging a concrete layer, transverse perforated steel plate units, steel grids and longitudinal steel tubes on a steel bottom plate.

In addition, the present disclosure further provides a construction method for the steel-concrete composite bridge deck slab with steel tube-perfobond rib shear connectors, which guarantees that the steel-concrete composite bridge deck slab can be manufactured relatively rapidly and efficiently.

The technical solution adopted in the present disclosure to solve the above problem is as follows: a steel-concrete composite bridge deck slab with steel tube-perfobond rib shear connectors, structurally including a steel bottom plate and a concrete layer, and further including transverse perforated steel plate units arranged on the steel bottom plate, steel grids arranged on upper surfaces of the transverse perforated steel plate units and longitudinal steel tubes arranged in an inserted manner on the transverse perforated steel plate units.

In a further preferable technical solution, each of the transverse perforated steel plate units includes a vertical rectangular steel plate with a length direction thereof being a transverse bridge direction, and a long round hole formed in the vertical rectangular steel plate and used for inserting the longitudinal steel tube.

In a further preferable technical solution, the long round hole includes a middle rectangular region and two half-round end regions.

In a further preferable technical solution, the diameter of each of the half-round end regions is 110-120% of the outer diameter of the longitudinal steel tube and is equal to the width of the middle rectangular region.

In a further preferable technical solution, 4-20 steel bottom plates are welded and fixed to each steel grid.

In a further preferable technical solution, a reinforcing frame unit for welding the steel grid and blocking and limiting the longitudinal steel tube is arranged at a splicing position of the four adjacent steel bottom plates.

In a further preferable technical solution, the reinforcing frame unit includes a bottom frame arranged in a welded manner on the four adjacent steel bottom plates, a vertical column arranged on the bottom frame, a transverse limiting plate arranged on the vertical column and used for blocking ends of the rowed longitudinal steel tubes in the transverse bridge direction, and a protruding column arranged on the transverse limiting plate and used for welding the steel grid.

In a further preferable technical solution, the reinforcing frame unit further includes a transverse amplifying plate arranged on the protruding column and used for enlarging an effective welding region.

In a further preferable technical solution, the steel bottom plate is square, and the single steel bottom plate is provided with two transverse perforated steel plate units and eight longitudinal steel tubes.

A construction method for a steel-concrete composite bridge deck slab with steel tube-perfobond rib shear connectors, successively including the following steps:

S1: paving the steel bottom plate on a steel main beam;

S2: pre-splicing all the longitudinal steel tubes and transverse perforated steel plate units needed by the single steel bottom plate firstly;

S3: welding the transverse perforated steel plate units to an upper surface of the steel bottom plate;

S4: pulling and aligning all the longitudinal steel tubes on the transverse perforated steel plate units;

S5: paving, welding and fixing the steel grids on the transverse perforated steel plate units; and S6: pouring concrete onto the steel bottom plate, and performing vibrating, ramming and curing to obtain the final steel-concrete composite bridge deck slab.

Figure 1:
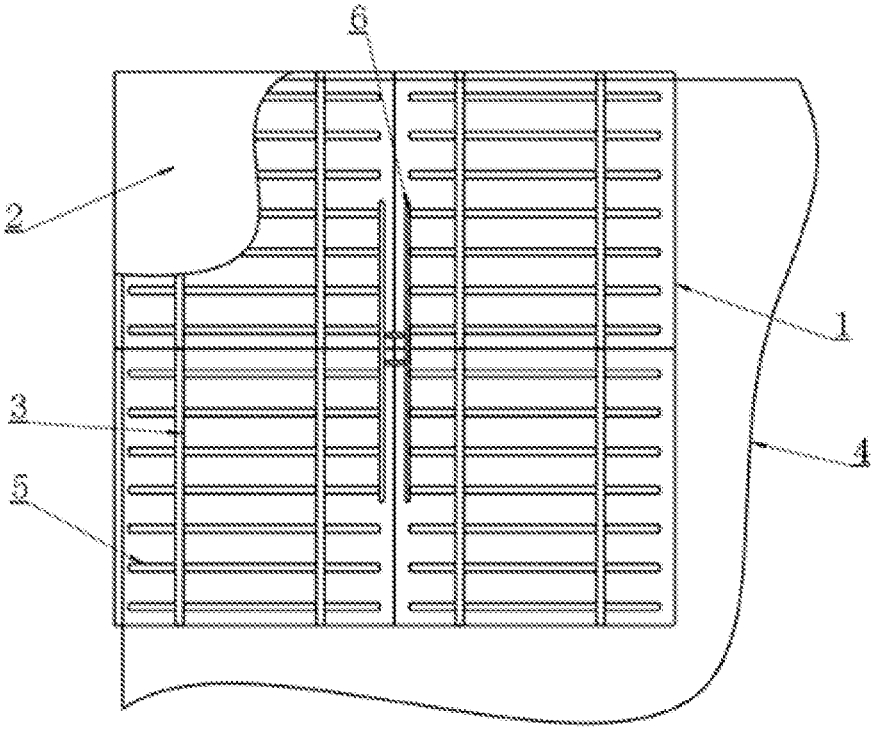
FIG. 1 is a structural schematic diagram of a steel-concrete composite bridge deck slab in the present disclosure.

In the drawings, reference numerals are represented as follows:

1—steel bottom plate; 2—concrete layer; 3—transverse perforated steel plate unit; 4—steel grid; 5—longitudinal steel tube; 301—vertical rectangular steel plate; 302—long round hole; 6—reinforcing frame unit; 601—bottom frame; 602—vertical column; 603—transverse limiting plate; 604—protruding column; 605—transverse amplifying plate.

DESCRIPTION OF THE EMBODIMENTS

The following is merely preferred embodiments of the present disclosure and is not intended to limit the scope of the present disclosure.

Figure 2:
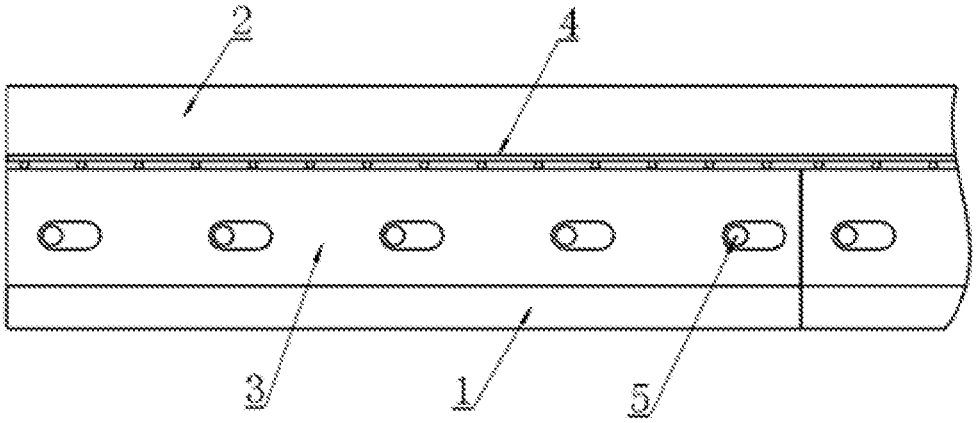
FIG. 2 is a structural schematic diagram where steel grids and a concrete layer are integrally paved.
Figure 3:
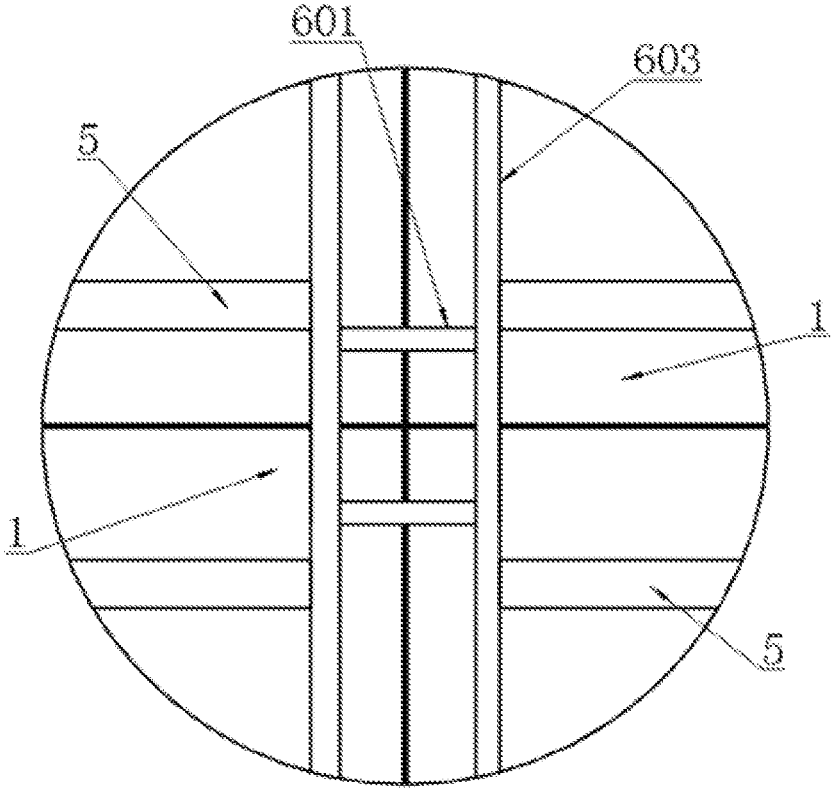
FIG. 3 is a top view illustrating a schematic diagram of a position structure of a reinforcing frame unit in the present disclosure.
Figure 4:
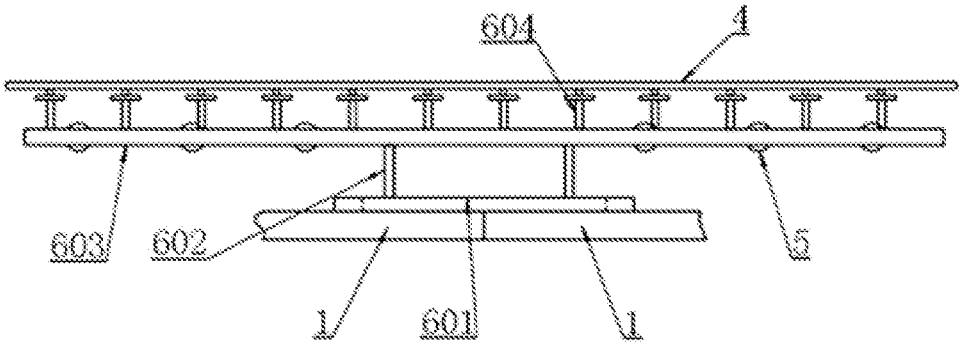
FIG. 4 is a schematic diagram of a usage mode of the reinforcing frame unit in the present disclosure.
Figure 5:
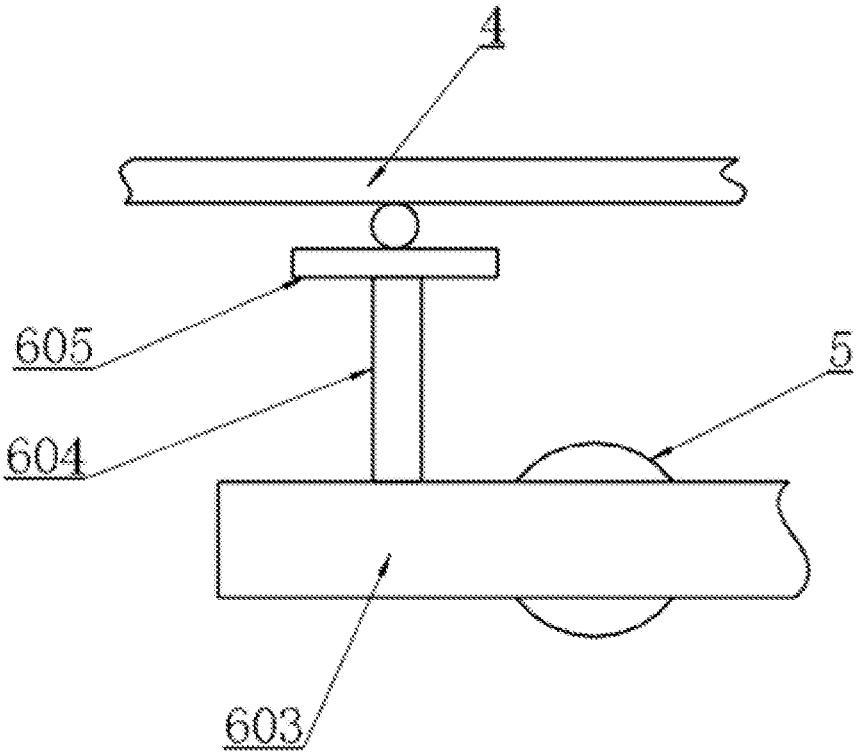
FIG. 5 is a schematic diagram of a usage mode of a transverse amplifying plate in the present disclosure.
Figure 6:
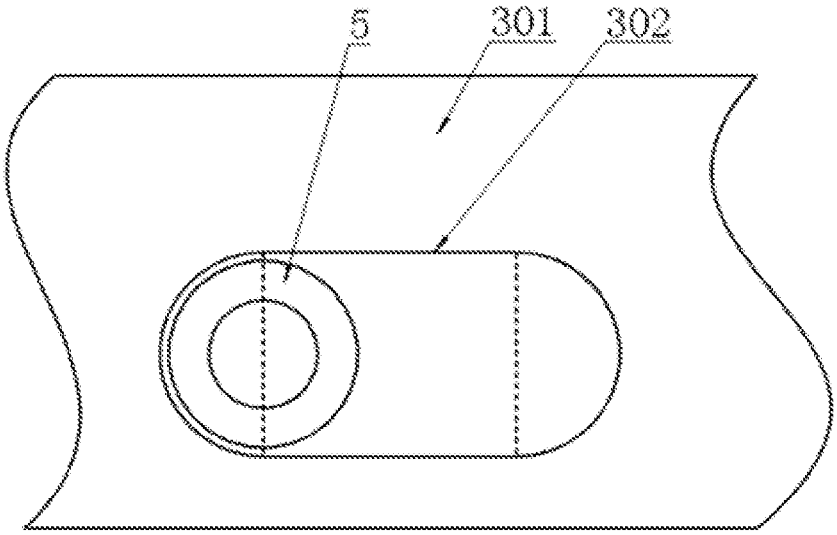
FIG. 6 is a schematic diagram of a usage mode of a long round hole in the present disclosure.

As shown in FIGS. 1-6, a steel-concrete composite bridge deck slab with steel tube-perfobond rib shear connectors, structurally includes a steel bottom plate 1 and a concrete layer 2, and further includes transverse perforated steel plate units 3 arranged on the steel bottom plate 1, steel grids 4 arranged on upper surfaces of the transverse perforated steel plate units 3 and longitudinal steel tubes 5 arranged in an inserted manner on the transverse perforated steel plate units 3.

In the embodiment, the concrete layer 2 and the steel grids 4, the steel grids 4 and the steel bottom plates 1 are often in a "one-to-more" relation. Thickness of the concrete layer 2 is relatively large to cover the steel grids 4 thoroughly. In addition, the steel grid 4 includes transverse and vertical reinforcing steel bars which are welded and prefabricated.

Finally, with respect to the bridge deck slab, the demands on the structural strength and bending strength in the longitudinal bridge direction are higher than those in the transverse bridge direction. Therefore, the quantity of the longitudinal steel tubes 5 is greater than that of the transverse perforated steel plate units 3 with higher concentration density.

Each of the transverse perforated steel plate units 3 includes a vertical rectangular steel plate 301 with a length direction thereof being a transverse bridge direction, and a long round hole 302 formed in the vertical rectangular steel plate 301 and used for inserting the longitudinal steel tube 5.

In the embodiment, a concrete bolt can be formed at the long round hole 302, guaranteeing the basic PBL shear performance. In addition, the vertical rectangular steel plate 301 is perpendicular to the steel bottom plate 1.

The long round hole 302 includes a middle rectangular region and two half-round end regions.

In the embodiment, by way of large transverse dimension, the long round hole 302 guarantees that 1) the dimension of the concrete bolt at the position is larger; and 2), the longitudinal steel tube 5 is relatively easily inserted.

The diameter of each of the half-round end regions is 110-120% of the outer diameter of the longitudinal steel tube 5 and is equal to the width of the middle rectangular region.

In the embodiment, the diametric position of each of the half-round end regions is the wide edge position of the middle rectangular region.

4-20 steel bottom plates 1 are welded and fixed to each steel grid 4.

In the embodiment, the length and width of the steel grid 4 are far larger than those of the steel bottom plate 1. Therefore, when the steel grid 4 is welded, the steel bottom plate 1 cannot rotate, slide, overlap and upwarp, otherwise, the welding difficulty of the steel grid 4 is extremely high, and the welding quality will be reduced greatly as well.

A reinforcing frame unit 6 for welding the steel grid 4 and blocking and limiting the longitudinal steel tube 5 is arranged at a splicing position of the four adjacent steel bottom plates 1.

In the embodiment, one reinforcing frame unit 6 corresponds to four steel bottom plates 1, guaranteeing that before the steel grid 4 is welded, all steel bottom plates 1 corresponding thereto can "assemble the parts into a whole", thereby preventing the welding quality of the steel grid 4 from being affected by the irregular positions of the steel bottom plates 1.

The reinforcing frame unit 6 includes a bottom frame 601 arranged in a welded manner on the four adjacent steel bottom plates 1, a vertical column 602 arranged on the bottom frame 601, a transverse limiting plate 603 arranged on the vertical column 602 and used for blocking ends of the rowed longitudinal steel tubes 5 in the transverse bridge direction, and a protruding column 604 arranged on the transverse limiting plate 603 and used for welding the steel grid 4.

In the embodiment, the bottom frame 601 is square, and each edge stretches across two steel bottom plates 1 and is welded therewith. Therefore, at least eight welding spots are provided on the bottom frame 601.

In addition, the transverse limiting plate 603 is used for blocking and limiting half quantity of the longitudinal steel tubes 5 on the single steel bottom plate 1, and one side of one steel bottom plate 1 corresponds to two reinforcing frame units 6, so that it can be guaranteed that both ends of all the longitudinal steel tubes 5 can be fully fixed.

Finally, the quantity of the protruding columns 604 is relatively large, guaranteeing as many as possible welding positions between the protruding columns and the steel grids 4.

The reinforcing frame unit 6 further includes a transverse amplifying plate 605 arranged on the protruding column 604 and used for enlarging an effective welding region.

In the embodiment, the protruding columns 604 and the reinforcing steel bars in the longitudinal bridge direction can only be welded in a "point-to-point" manner originally, so that a major quantity of them may not be touched and welded. Therefore, after introducing the transverse amplifying plate 605, it becomes "point-to-face" welding. The probability of full contact of the two is improved greatly, which further guarantees the welding and installation stability of the steel grid 4.

The steel bottom plate 1 is square, and the single steel bottom plate 1 is provided with two transverse perforated steel plate units 3 and eight longitudinal steel tubes 5.

In the embodiment, the shear performance in the transverse bridge direction of the vertical rectangular steel plate 301 and the shear performance in the longitudinal bridge direction of the longitudinal steel tube 5 can be integrated through the long round hole 302, guaranteeing a more sufficient "reinforced shear key" effect.

The above quantity relation can further guarantee a relatively small weight of the bridge deck slab in the premise of enough structural strength of the bridge deck slab.

A method for constructing the steel-concrete composite bridge deck slab with steel tube-perfobond rib shear connectors, successively including the following steps:

S1: paving the steel bottom plate 1 on a steel main beam;

S2: pre-splicing all the longitudinal steel tubes 5 and transverse perforated steel plate units 3 needed by the single steel bottom plate 1 firstly;

S3: welding the transverse perforated steel plate units 3 to an upper surface of the steel bottom plate 1;

S4: pulling and aligning all the longitudinal steel tubes 5 on the transverse perforated steel plate units 3;

S5: paving, welding and fixing the steel grids 4 on the transverse perforated steel plate units 3; and S6: pouring concrete onto the steel bottom plate 1, and vibrating, ramming and curing to obtain the final steel-concrete composite bridge deck slab.

In step S3 of the embodiment, if the transverse perforated steel plate units 3 are welded first and then the longitudinal steel tubes 5 are inserted, the problem that they cannot be inserted may occur.

In addition, with respect to the longitudinal steel tubes 5, they cannot abut against each other completely end to end in the longitudinal bridge direction, and otherwise, there will be a harmful internal force when the bridge deck slab is subjected to normal subtle deformation. This is the basis for arranging the reinforcing frame units 6 and the reason why the transverse limiting plate 603 is not welded to the ends of the longitudinal steel tubes 5.

Furthermore, if both sides of the rowed longitudinal steel tubes 5 are not aligned, with respect to the bridge deck slab, the force transfer mode, force transfer speed and the like thereof are nonuniform, which affects normal use.

Finally, the present disclosure has the following advantages:

1, the transverse perforated steel plate units 3 are provided in the transverse bridge direction and the longitudinal steel tubes 5 are provided in the longitudinal bridge direction, guaranteeing that the bridge deck slab has basic bending strength and shear performance in both the transverse bridge direction and the longitudinal bridge direction.

2, the longitudinal steel tubes 5 are further spliced with the transverse perforated steel plate units 3, so that the whole forms a "reinforced shear key", which further improves the shear performance of the bridge deck slab.

3, the steel bottom plates 1 are further provided with the reinforcing frame units 6, so that the steel bottom plates 1 can be connected as a whole, the reinforcing frame units are in the middle to limit the longitudinal steel tubes 5 and to further reinforce and weld the steel grids 4, so as to finally strengthen the structural integrity of the bridge deck slab.

4, with respect to the reinforcing frame units 6 themselves, the operations of welding to the steel bottom plates 1 and to the steel grids 4 are relatively simple and convenient.

Detailed description has been made on the embodiments of the present disclosure in combination of the accompanying draws above. But the present disclosure is not limited to the above-mentioned implementation modes. Those of ordinary skill further can make various modifications without departing from the concept of the present disclosure within their knowledge. These are modifications without inventiveness, and those in the scope of claims of the present disclosure are protected by patent law.

What is claimed is:

1. A steel-concrete composite bridge deck slab with steel tube-perfobond rib shear connectors, structurally comprising a steel bottom plate and a concrete layer, and further comprising transverse perforated steel plate units arranged on the steel bottom plate, steel grids arranged on upper surfaces of the transverse perforated steel plate units and longitudinal steel tubes arranged in an inserted manner on the transverse perforated steel plate units;

wherein a reinforcing frame unit for welding the steel grid and blocking and limiting the longitudinal steel tube is arranged at a splicing position of four adjacent steel bottom plates.

2. The steel-concrete composite bridge deck slab with steel tube-perfobond rib shear connectors according to claim 1, wherein each of the transverse perforated steel plate units comprises a vertical rectangular steel plate with a length direction thereof being a transverse bridge direction, and a long round hole formed in the vertical rectangular steel plate and used for inserting the longitudinal steel tube.

3. The steel-concrete composite bridge deck slab with steel tube-perfobond rib shear connectors according to claim 2, wherein the long round hole comprises a middle rectangular region and two half-round end regions.

4. The steel-concrete composite bridge deck slab with steel tube-perfobond rib shear connectors according to claim 3, wherein a diameter of each of the half-round end regions is 110-120% of an outer diameter of the longitudinal steel tube and is equal to a width of the middle rectangular region.

5. The steel-concrete composite bridge deck slab with steel tube-perfobond rib shear connectors according to claim 1, wherein 4-20 steel bottom plates are welded and fixed to each steel grid.

6. The steel-concrete composite bridge deck slab with steel tube-perfobond rib shear connectors according to claim 1, wherein the reinforcing frame unit comprises a bottom frame arranged in a welded manner on the four adjacent steel bottom plates, a vertical column arranged on the bottom frame, a transverse limiting plate arranged on the vertical column and used for blocking ends of the rowed longitudinal steel tubes in a transverse bridge direction, and a protruding column arranged on the transverse limiting plate and used for welding the steel grid.

7. The steel-concrete composite bridge deck slab with steel tube-perfobond rib shear connectors according to claim 6, wherein the reinforcing frame unit further comprises a transverse amplifying plate arranged on the protruding column and used for enlarging an effective welding region.

8. The steel-concrete composite bridge deck slab with steel tube-perfobond rib shear connectors according to claim 1, wherein the steel bottom plate is square, and the single steel bottom plate is provided with two transverse perforated steel plate units and eight longitudinal steel tubes.

9. A method for constructing the steel-concrete composite bridge deck slab with steel tube-perfobond rib shear connectors according to claim 1, successively comprising the following steps:

(S1): paving the steel bottom plate on a steel main beam;

(S2): pre-splicing all the longitudinal steel tubes and the transverse perforated steel plate units needed by the single steel bottom plate firstly;

(S3): welding the transverse perforated steel plate units to an upper surface of the steel bottom plate;

(S4): pulling and aligning all the longitudinal steel tubes on the transverse perforated steel plate units;

(S5): paving, welding and fixing the steel grids on the transverse perforated steel plate units; and (S6): pouring concrete onto the steel bottom plate, and performing vibrating, ramming and curing to obtain the final steel-concrete composite bridge deck slab.

* * * * *